US007920035B2

(12) United States Patent
Panaghiston

(10) Patent No.: US 7,920,035 B2
(45) Date of Patent: Apr. 5, 2011

(54) MICROWAVE POWER SPLITTER/COMBINER

(75) Inventor: Gary David Panaghiston, Billericay (GB)

(73) Assignee: Selex Galileo Ltd., Basildon, Essex (GB)

( * ) Notice: Subject to any disclaimer, the term of this patent is extended or adjusted under 35 U.S.C. 154(b) by 638 days.

(21) Appl. No.: 11/661,190

(22) PCT Filed: Nov. 29, 2006

(86) PCT No.: PCT/GB2006/050419

§ 371 (c)(1), (2), (4) Date: Feb. 26, 2007

(87) PCT Pub. No.: WO2007/063344

PCT Pub. Date: Jun. 7, 2006

(65) Prior Publication Data

US 2009/0002092 A1 Jan. 1, 2009

(30) Foreign Application Priority Data

Nov. 30, 2005 (GB) ..... 0524370.4
Feb. 9, 2006 (EP) ..... 06270013

(51) Int. Cl.
*H01P 3/08* (2006.01)
*H01P 5/12* (2006.01)

(52) U.S. Cl. ..... 333/128; 333/130; 333/134; 333/136

(58) Field of Classification Search ..... 333/125, 333/127, 128, 130, 134, 136
See application file for complete search history.

(56) References Cited

U.S. PATENT DOCUMENTS

| | | | | |
|---|---|---|---|---|
| 4,450,418 | A * | 5/1984 | Yum et al. | 333/128 |
| 4,639,694 | A * | 1/1987 | Seino et al. | 333/128 |
| 4,777,718 | A | 10/1988 | Henderson et al. | |
| 6,570,466 | B1 * | 5/2003 | Bahl | 333/128 |
| 7,213,327 | B2 * | 5/2007 | Su et al. | 29/610.1 |
| 2004/0061568 | A1 | 4/2004 | Ishida et al. | |

FOREIGN PATENT DOCUMENTS

| | | |
|---|---|---|
| EP | 0 735 605 A1 | 10/1996 |
| EP | 1 087 460 A2 | 3/2001 |
| JP | 2005-44955 A | 2/2005 |

OTHER PUBLICATIONS

Tokumitsu, et. al., *Multilayer MMIC Using a 3 μmXN-Layer Dielectric Film Structure,* IEICE Transactions on Electronics, vol. E75-C, No. 6, Jun. 1992, pp. 698-706.

(Continued)

*Primary Examiner* — Robert Pascal
*Assistant Examiner* — Kimberly E Glenn
(74) *Attorney, Agent, or Firm* — Crowell & Moring LLP

(57) ABSTRACT

A microwave, power splitter/combiner (20) is formed as part of a multilayer laminate (27, 28, 29, 33, 34) such that two ports (22, 23) are connected by plated vias (31, 32) to conductive pads (29, 30) connected across an isolation resistor (27). Furthermore, a microwave circuit is provided in the form of a multi-layer laminate including a substrate carrying a resistive layer which has been etched to define at least one resistor, a dielectric membrane covering the resistor, a conductive layer defining at least part of an electrical circuit, and said at least one resistor is electrically connected to the conductive layer by vias extending through the dielectric membrane.

13 Claims, 6 Drawing Sheets

OTHER PUBLICATIONS

Cheng, et. al., *Quantitative Analysis of Resistance Variations in as-Deposited Nickel-Phosphorus (NIP) Embedded Resistors,* 2003 Electronic Components and Technology Conference, IEEE, pp. 156-160.

Kautio, et. al., *20 GHz Wilkinson Power Dividers in LTCC Technology,* VTT Electronics, 2004, pp. 38-39.

Kassner, et. al., *Highly Integrated Power Distribution Networks on Multilayer LTCC for Ka-band Multiple-Beam Phased Array Antennas,* IMAPS Nordic Conference, Sep. 21, 2003, pp. 51-54.

Hasegawa, et. al., *Multi-Branch Power Dividers Using Multilayer MMIC Technology,* IEICE Transactions on Electronics, vol. E75-C, No. 6, Jun. 1992, pp. 707-712.

European Search Report dated Apr. 25, 2006 (Four (4) pages).

* cited by examiner

MICROWAVE POWER SPLITTER/COMBINER

This invention concerns microwave circuits and in particular, but not exclusively, the manufacture of a microwave power splitter/combiner either as a component, or as part of a manifold power splitter/combiner. More particularly, but not exclusively, the invention relates to the formation of a multi-layer laminate defining one or more microwave power splitter/combiners of the type originated by Ernest Wilkinson and commonly referred to as a Wilkinson splitter or a Wilkinson combiner.

The simplest form of Wilkinson splitter comprises a three port circuit which splits an input at a first port between two arms that constitute quarter-wave transformers each having a characteristic impedance of $1.414\times Z^{\circ}$ [$=Z^{\circ}\sqrt{2}$], and terminate respectively in the second and third ports which are interconnected by a $2\times Z^{\circ}$ isolation resistor; this configuration achieves equal split matching between all of the ports with low losses and a high isolation between the output ports. In operation as a splitter, an input signal entering the first port is split into equal-phase and equal-amplitude output signals at the second and third ports. The isolation resistor is decoupled from the input signal because its ends are at the same potential and no current passes through it.

The simplest form of Wilkinson combiner has the same structure but combines input signals at the second and third ports to produce an output signal at the first port. An input signal at either the second port or the third port has half of its power dissipated in the resistor in a manner well known in the art, with the remainder transmitted to the first port. The resistor therefore decouples the second and third ports.

Wilkinson splitters and combiners are well known to have a range of configurations all requiring the provision of at least one isolation resistor. Although some of these splitter and combiner designs have more than three ports, for instance 3:1 and 4:1 configurations, they all require a ported circuit defining at least three ports. The invention enables high insertion losses at microwave frequencies to be reduced.

According to one aspect of the invention, a microwave power splitter/combiner comprises a multi-layer laminate including a substrate carrying a resistive layer which has been etched to define a resistor, a dielectric membrane covering the resistor, a conductive layer defining at least part of an electrical circuit of the power splitter/combiner, and two ports of the power splitter/combiner are electrically connected across the resistor by vias extending through the dielectric membrane.

The resistive layer is preferably formed from a nickel-phosphorus alloy.

The resistive layer may have been etched to define a profile similar to the microwave circuit, the conductive layer defining the microwave circuit has been deposited on the etched profile of the resistive layer, and the two ports are electrically connected by the vias to the microwave circuit.

Alternatively the resistive layer may define a discrete resistor, conductive pads are secured to the resistor, the conductive layer is formed on the opposite side of the dielectric membrane to the discrete resistor, and the two ports are electrically connected by the vias one to each of the conductive pads.

The conductive pads are preferably formed of copper. The multi-layer laminate preferably includes a copper foil covering the resistive layer, the copper foil having been etched to define the conductive pads.

The dielectric membrane is preferably formed from expanded poly-tetra-flouro-ethelyene impregnated with a thermoset resin. The conductive layer is preferably formed from copper.

According to another aspect of the invention, a manifold power splitter/combiner comprises a multi-layer laminate defining a plurality of microwave power splitters/combiners each as hereinbefore specified, the conductive layer being etched to define the electrical connections between the microwave circuits of the power splitters/combiners.

According to another aspect of the invention, a method of manufacturing a microwave power splitter/combiner comprises forming a laminate including a substrate carrying a resistive layer, a conductive layer carried by the resistive layer, a dielectric membrane covering the conductive layer, and at least three ports arranged on the opposite side of the dielectric layer to the conductive layer, including etching the resistive layer and the conductive layer to define a microwave circuit for the microwave power splitter/combiner with an integral resistor, and forming electrically conductive vias through the dielectric membrane to connect the ports to the microwave circuit.

According to a further aspect of the invention, a method of manufacturing a microwave power splitter/combiner comprises forming a laminate including a substrate carrying a resistive layer, a first conductive layer carried by the resistive layer, a dielectric membrane covering the first conductive layer, and a second conductive layer covering the dielectric membrane, and includes etching the resistive layer and the first conductive layer to define a discrete resistor having conductive pads, etching the second conductive layer to define a microwave circuit of the power splitter/combiner, and forming electrically conductive vias through the dielectric membrane to connect two ports of the microwave circuit one to each of the conductive pads.

According to yet another aspect of the invention, a method of manufacturing a manifold power splitter/combiner comprises forming a laminate including a substrate carrying a resistive layer, a first conductive layer carried by the resistive layer, a dielectric membrane covering the first conductive layer, and a second conductive layer covering the dielectric membrane, and includes etching the resistive layer and the first conductive layer to define a plurality of discrete resistors each having conductive pads, etching the second conductive layer to define an equivalent plurality of ported microwave circuits of power splitters/combiners together with electrical interconnections, and forming electrically conductive vias through the dielectric membrane to connect two ports of each ported microwave circuit one to each of the conductive pads of one of the discrete resistors.

The method may also include testing the value of each resistor before placing the dielectric membrane over the conductive pads.

The method may further include adjusting the value of any resistor to a specified value before placing the dielectric membrane over the resistor.

According to yet another aspect of the invention, the invention resides in a microwave circuit in the form of a multi-layer laminate including a substrate carrying a resistive layer which has been etched to define at least one resistor, a dielectric membrane covering the resistor, a conductive layer defining at least part of an electrical circuit, and said at least one resistor is electrically connected to the conductive layer by vias extending through the dielectric membrane.

In a preferred embodiment, the resistive layer defines a discrete resistor, conductive pads are secured to the resistor, the conductive layer is formed on the opposite side of the dielectric membrane to the discrete resistor, and the vias extend one to each of the conductive pads.

In preferred embodiments of the present invention, the use of a separate resistive layer eliminates resistive elements from the main circuit layer which has the advantage that losses otherwise associated with resistors provided in the main circuit layer are reduced or substantially eliminated. Furthermore, during manufacture of the circuit, DC testing of the resistors can be carried out separately from testing of the main circuit.

The invention is now described, by way of example only, with reference to the accompanying drawings, in which:—

Figure 1:
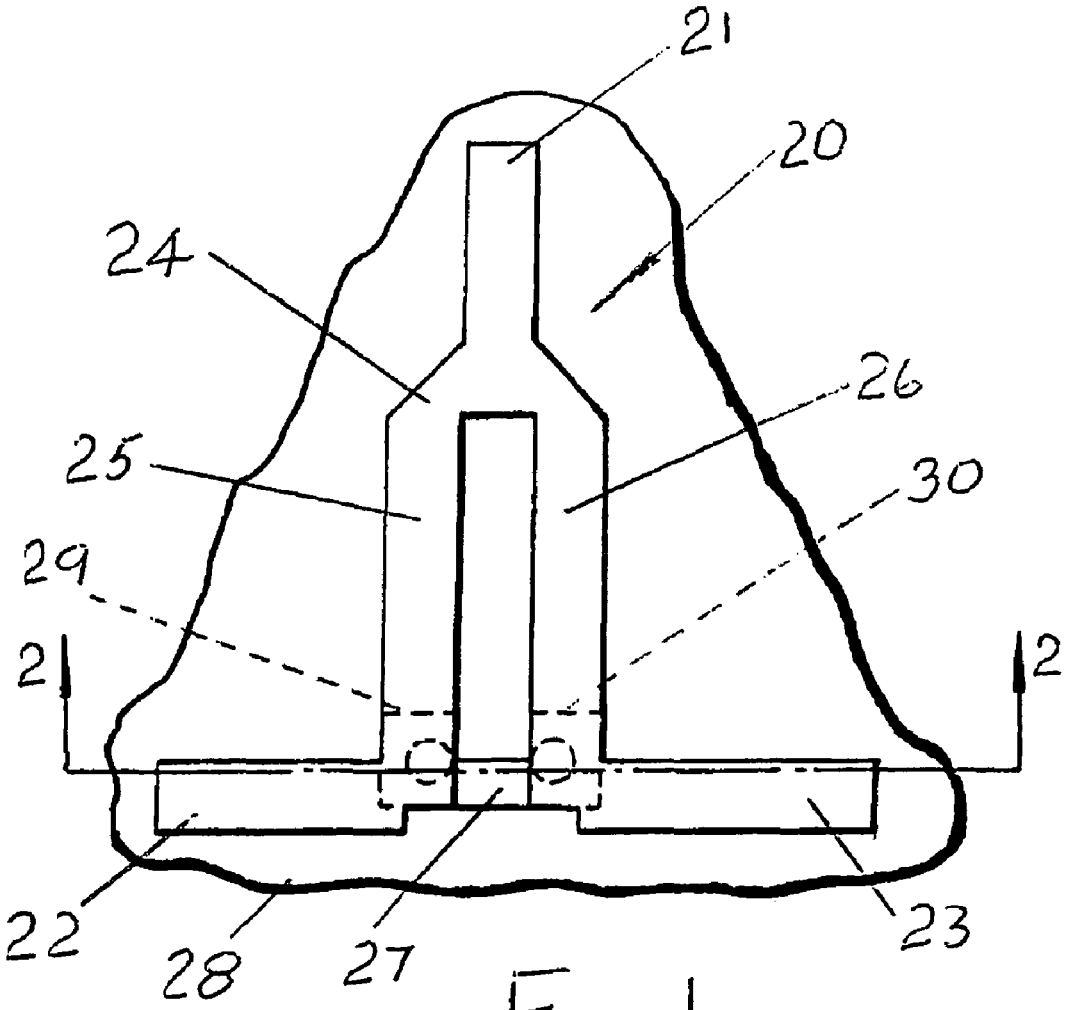
FIG. 1 is a plan view of part of a multi-layer laminate comprising a first embodiment of a single Wilkinson power splitter/combiner.
Figure 2:
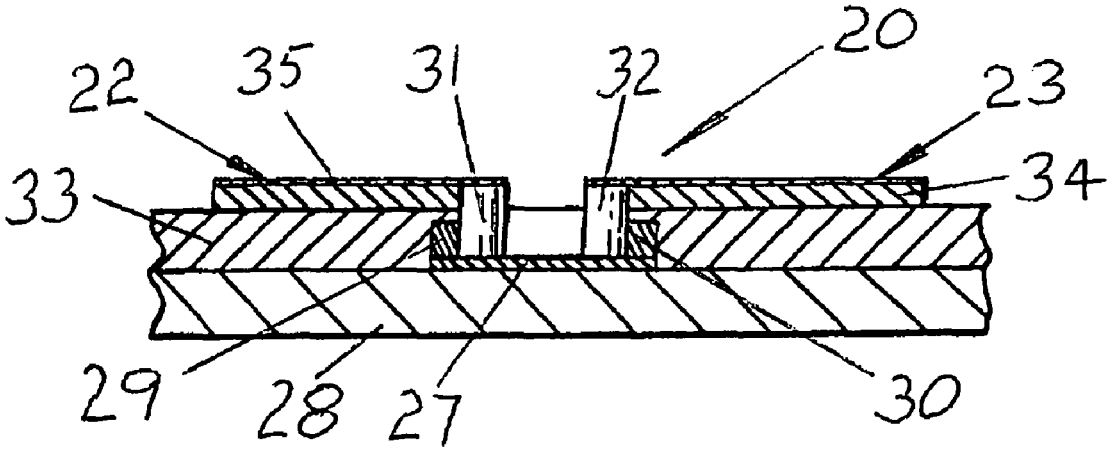
FIG. 2 is a section taken along the line 2-2 in FIG. 1.
Figure 3:
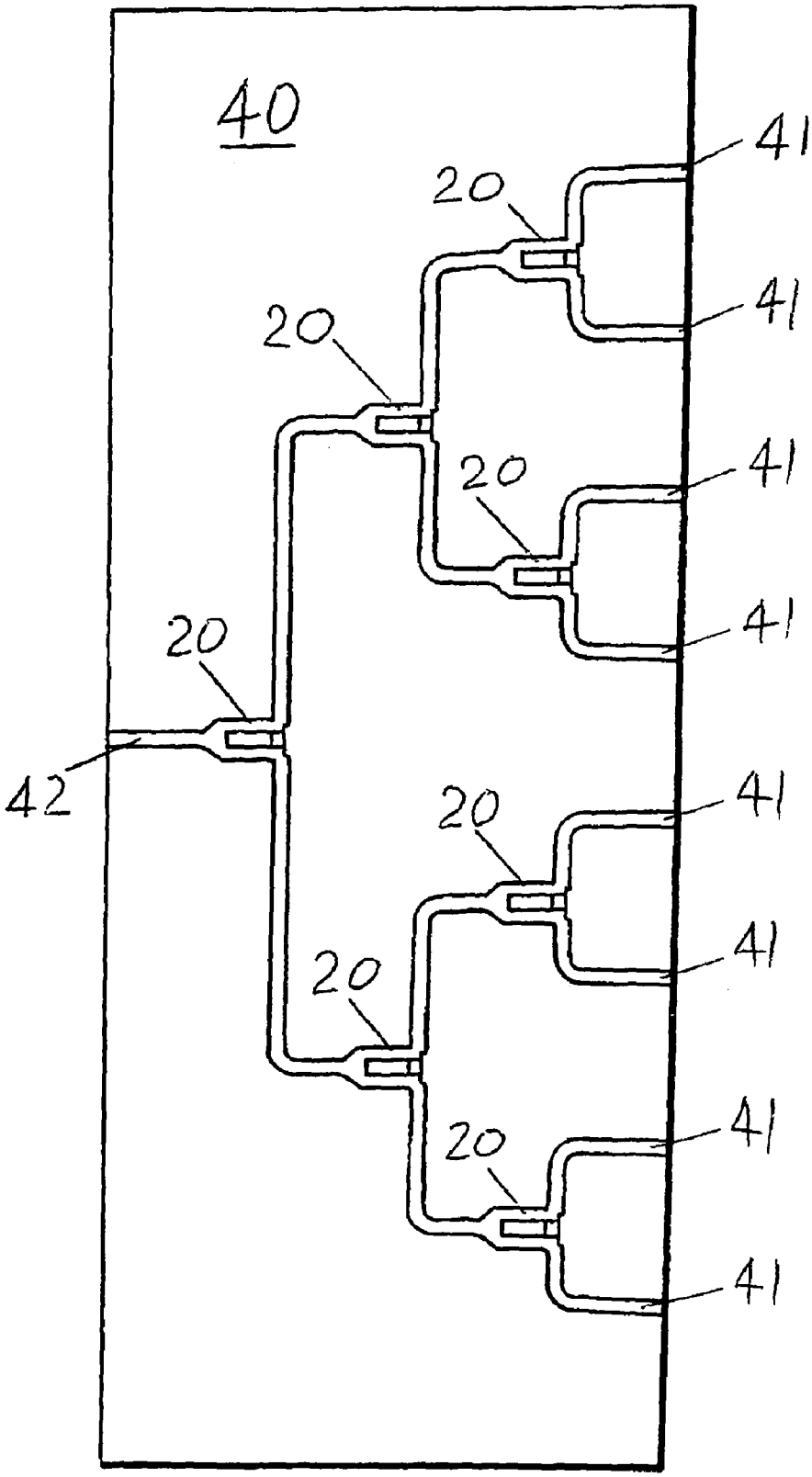
FIG. 3 is a plan view of a manifold power combiner comprising seven Wilkinson power splitter/combiners formed as shown in FIGS. 1 and 2.
Figure 16:
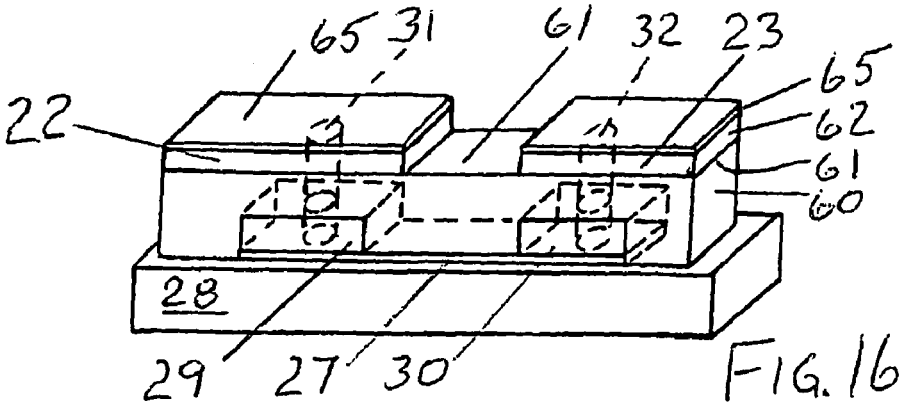
Figure 17:
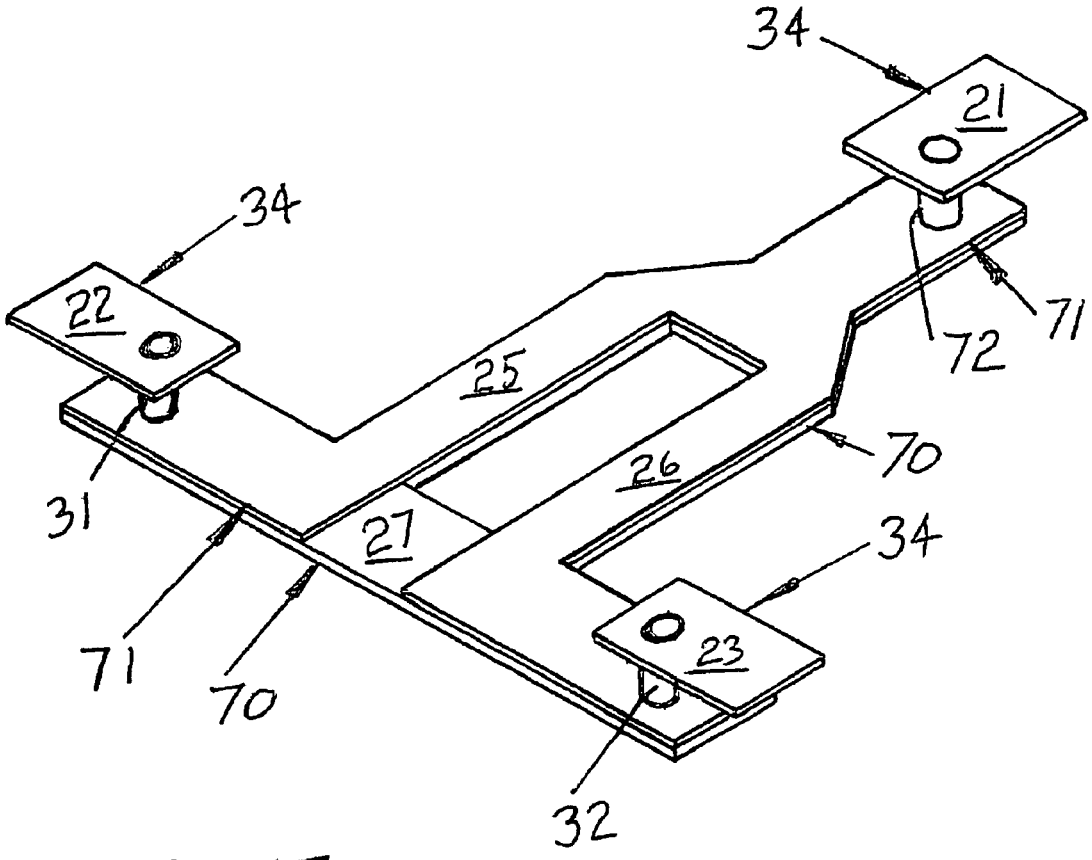

FIGS. 4 to 16 illustrate diagrammatically a method of manufacturing the Wilkinson power splitter/combiners illustrated in FIGS. 1 to 3 [this process is a variant of the one etch process generally known as the "Gould Process" which was originated by Gould Electronics Inc. of Eastlake, Ohio, USA using a thin film embedded resistor identified by their trademark TCR]; and FIG. 17 is an isometric view of a second embodiment of a single Wilkinson splitter/combiner with various layers of the laminate omitted for clarity.

In the following description, preferred embodiments of the present invention are described with reference to the manufacture of a particular microwave circuit component—a Wilkinson power splitter/combiner. However, all preferred embodiments described below may be applied to microwave circuits of a general nature having one or more resistors, not necessarily including a Wilkinson power splitter/combiner, and to a method of their manufacture. In particular, preferred embodiments of the present invention may be directed to microwave circuits in general, and to techniques for their manufacture, in the form of a multi-layer laminate having a separate resistive layer to that carrying the main circuit.

With reference to FIGS. 1 and 2, a Wilkinson power splitter/combiner 20 defines three ports 21, 22 and 23 which are interconnected by a conductive layer 24 defining a pair of arms 25, 26 constituting quarter-wave transformers each having a characteristic impedance of $1.414 \times Z°$ [or $Z°\sqrt{2}$] in a well-known manner. The ports 22 and 23 are also interconnected by a discrete $2 \times Z°$ isolation resistor 27 carried by a substrate 28. Conductive pads 29, 30 are conductively secured to the ends of the discrete resistor 27, as shown in FIG. 2, and are electrically connected to the ports 22 and 23 by respective plated vias 31 and 32.

As will be described later in detail, the resistor 27 has been etched, to the size and shape illustrated in FIGS. 1 and 2, from a resistive layer that originally covered the upper surface of the substrate 28. The conductive pads 29, 30 are formed from copper that has been plated onto surfaces defined by the ends of the resistor 27 as illustrated, and then covered by a dielectric membrane 33 carrying a conductive layer 34, for instance of copper, which is etched to define the ported circuit of the Wilkinson splitter/combiner 20 including ports 21, 22 and 23, and the pair of arms 25 and 26. The vias 31, 32 are formed in any convenient manner, for instance by using an excimer laser, followed by electro-plating to provide good electrical connections between the conductive pad 29 and the port 22, and between the conductive pad 30 and the port 23, a plated layer 35 also being deposited on top of the entire upper profile of the copper sheet 34. It should be noted that, whilst the copper sheet 34 is positioned on top of the dielectric membrane 33, the resistor 27 and its associated conductive pads 29 and 30 are encased between the substrate 28 and the dielectric membrane 33.

In use as a microwave power splitter, a microwave input entering port 21 will be split into equal-phase and equal amplitude outputs at ports 22 and 23.

In use as a microwave power combiner, microwave inputs entering the ports 22 and 23 will be combined to produce an output signal at port 21.

Although the Wilkinson splitter/combiner 20 illustrated in FIGS. 1 and 2 could be a single electronic component mounted on its own area of laminate 27, 28, 33, 34, a plurality of Wilkinson splitters/combiners 20 could be formed on the same laminate, for instance as illustrated in FIG. 3.

In FIG. 3 an eight-way manifold combiner 40 comprises seven Wilkinson combiners 20 formed on the same laminate in the manner described with reference to FIGS. 1 and 2, the combiners 20 having their ports interconnected as shown such that inputs entering the eight input ports 41 will be combined at the single output port 42. By changing the ports so that port 42 is the input and ports 41 are the outputs, the eight-way manifold 40 becomes a splitter. Manifold splitters are used, for instance, as components in the construction of microwave radiating elements, whilst manifold combiners are useful as components in the construction of microwave antennas. Although FIG. 3 illustrates an eight-way manifold combiner, different configurations of Wilkinson splitters or combiners can be interconnected to provide different configurations, for instance a six-way manifold combiner or splitter.

The Wilkinson splitter/combiner 20, described with reference to FIGS. 1 and 2, can be formed using the method that is now described with reference to FIGS. 4 to 16 which diagrammatically show the sequential formation and attachment of the ports 22 and 23 to their respective ends of the discrete isolation resistor 27. The reference numerals used in FIGS. 1 to 3 are used, wherever appropriate, in FIGS. 4 to 16 and denote the same features unless stated to the contrary.

Figure 4:
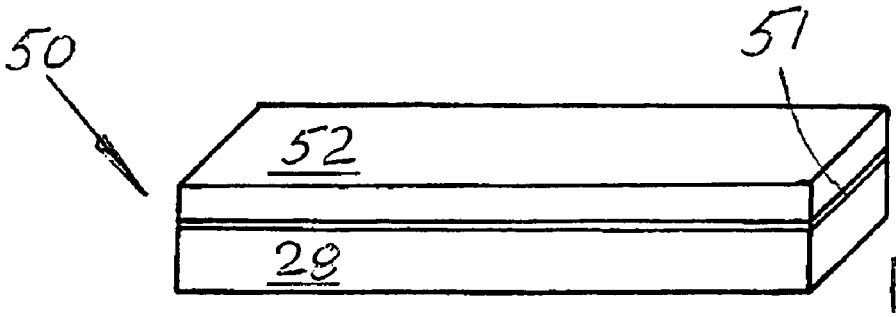

The method of manufacture utilises a laminated sheet 50, as shown in FIG. 4, comprising a thin layer of resistive material 51 laminated between a copper foil 52 and a dielectric sheet defining the substrate 28. The layer of resistive material can comprise either a thin-film nickel-phosphorous alloy of about 0.1 to 0.4 microns thick supplied by Ωhmega Technologies Inc. under their trade mark Ohmega-Ply, or a thin film embedded resistor of the type supplied by Gould Electronics Inc. under their trademark TCR.

Figure 5:
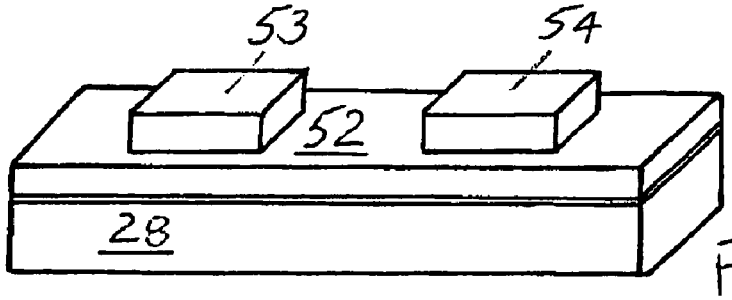
Figure 6:
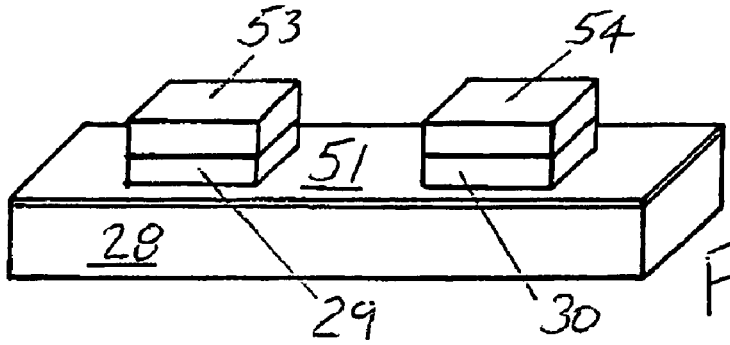

As shown in FIG. 5, two areas 53 and 54 of photoresist are applied to the copper foil 52, then exposed and developed. The uncovered area of the copper foil 52 is then etched, as indicated in FIG. 6, to expose the resistive material 51 except where it is covered by the photoresist areas 53 and 54 and the intervening area of copper foil which will define the conductive pads 29 and 30.

Figure 7:
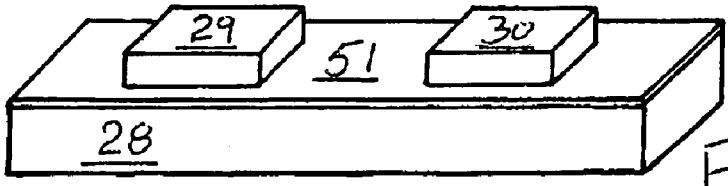
Figure 8:
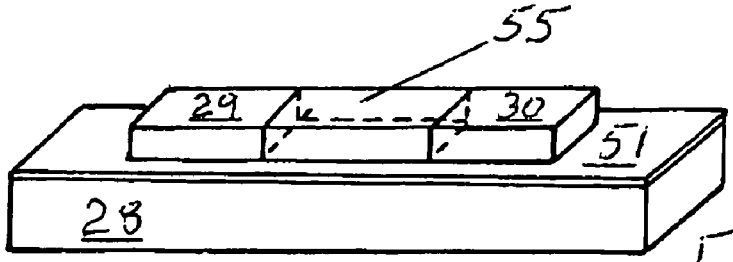
Figure 9:
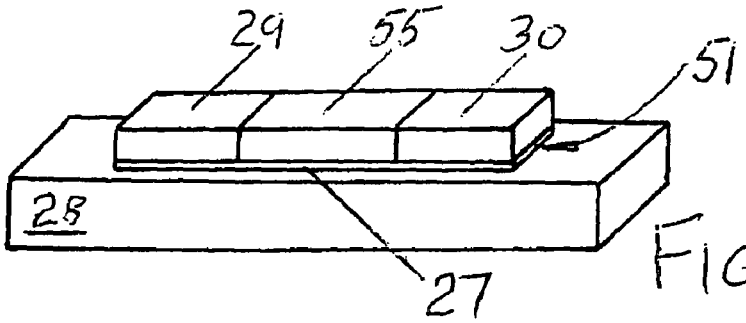

The next stage is shown in FIG. 7 and involves stripping the photoresist areas 53 and 54 to expose the conductive pads 20 and 30. FIG. 8 shows the application of photoresist 55 to the upper surface of the resistive material 51 between the conductive pads 29 and 30. An etching solution that does not attack copper is then used to strip the exposed area of the resistive material 51 as shown in FIG. 9, thereby leaving an area of the resistive material 51 defining the discrete isolation resistor 27.

Figure 10:
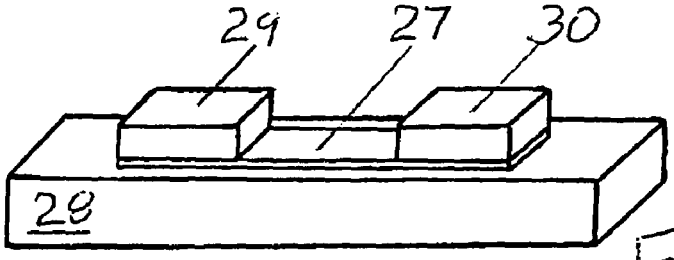

The next step is to strip the photoresist 55 to achieve the structure shown in FIG. 10 in which the discrete isolation resistor 27 is carried by the substrate 28 and carries the conductive pads 29 and 30. At this point in the process it is possible to check the value of the resistor 27 by applying an appropriate gauge across the pads 29 and 30. If the value of the resistor 27 is outside acceptable tolerances, the process can either be terminated to save further manufacturing costs, or the resistor 27 can be adjusted to fall within such tolerances. If the value of the resistor is too low, the portion between the pads 29 and 30 can have its surface abraded or pared until an appropriate resistance is achieved. On the other hand, if the value of the resistor is too high, its effective length can be shortened by adding copper to the inwardly-facing end of one of the pads 29 or 30.

Figure 11:
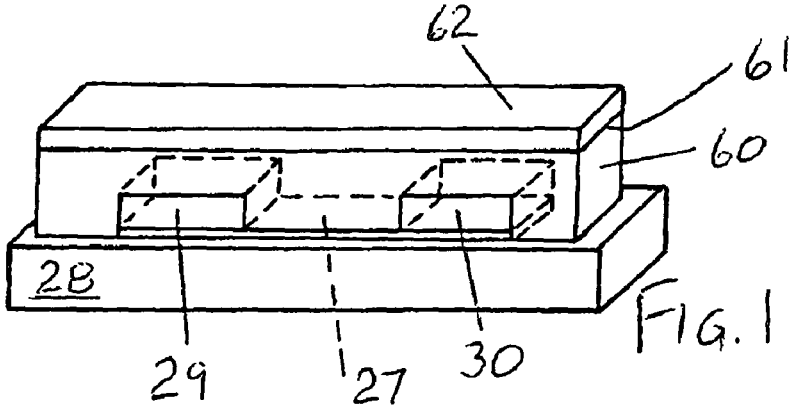

FIG. 11 shows the addition of further laminates comprising an expanded polytetrafluoroethane (PTFE) dielectric membrane 60 and a low melting point bonding film 61 carrying a copper layer 62. These layers are pressed against the pads 29 and 30 with an appropriate force and at an appropriate temperature until they are completely embedded in the dielectric membrane 60. A suitable material for the dielectric membrane 60 is a sheet of expanded PTFE impregnated with thermosetting resins, such as that manufactured by W L Gore and Associates Inc. of Newark, Del., USA under their trade mark SPEEDBOARD. A suitable material for the bonding film with copper layer is the laminate manufactured by Arlton, Inc. of Lancaster, United Kingdom under their trade mark CuClad 6700.

Figure 12:
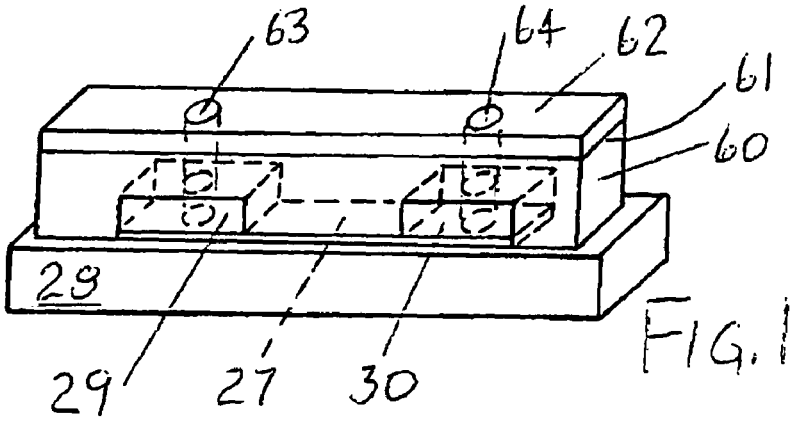
Figure 13:
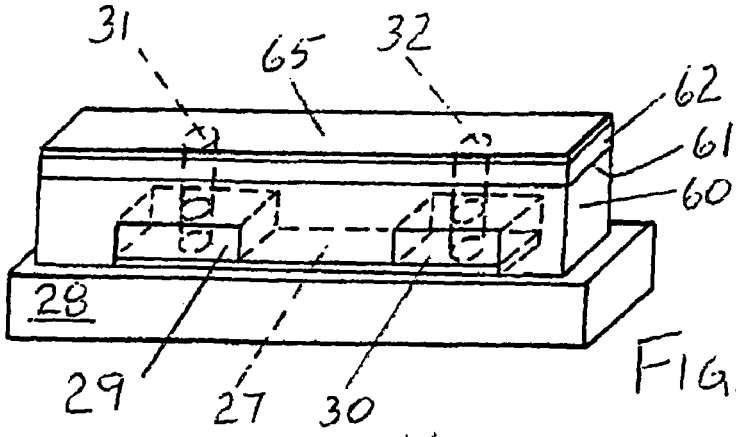

FIG. 12 shows the formation of via holes 63 and 64 extending vertically through the copper layer 62, the bonding film 61 and the dielectric membrane 60, into the conductive pads 29 and 30. The next step is a plating process, as indicated in FIG. 13, to fill the via holes 63, 64 with a conductive material, such as copper, to form the plated vias 31, 32, thereby electrically connecting the conductive pads 29 and 30 to the copper layer 62. During this plating process the surface of the copper layer 62 becomes covered with a plated layer 65 thereby enhancing electrical conductivity between the copper layer 62 and the plated vias 31, 32.

Figure 14:
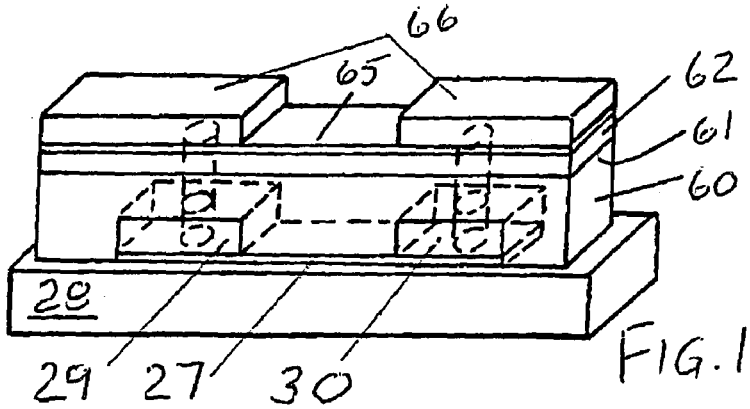

As shown in FIG. 14, the next step is to apply an area of photoresist 66 to the plated layer 65. Although this area of photoresist 66 is shown as two separate areas, the actual area is the plan of the splitter or combiner and any associated connections. The two areas of photoresist 66 are effectively the ports 22 and 23 of the splitter or combiner and would, of course, be connected to an adjacent area of photoresist defining the port 21 and the arms 25 and 26.

Figure 15:
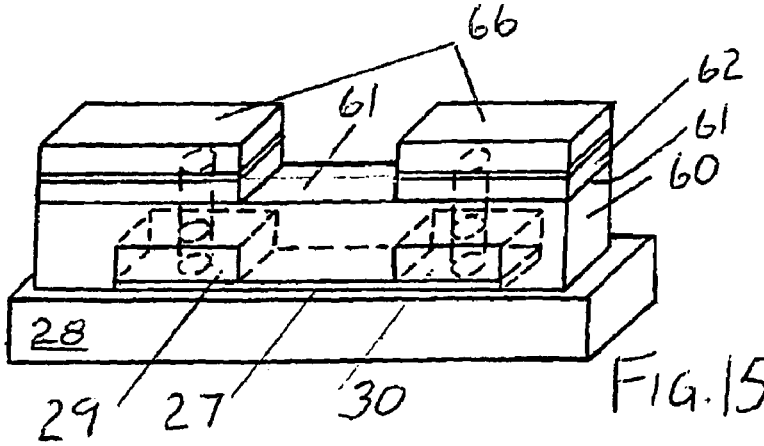

Photoresist 66 is then exposed and developed, and the exposed portions of the plated layer 65 and the copper layer 62 are etched away to produce the configuration shown in FIG. 15. The final step is stripping the photoresist 66 to leave the complete splitter/combiner as shown in FIG. 16.

Although the method of manufacture described with reference to FIGS. 4 to 16 is preferred, it may be modified to suit the selection of materials and their associated formation processes.

In an alternative method of manufacture, the area of photoresist 55 in FIGS. 8 and 9 can be increased to cover the entire outline of the Wilkinson power splitter/combiner 20 illustrated in FIG. 1. In this manner the area of resistive material 51 will be enlarged to the same size as the outline of the power splitter/combiner 20.

Removal of all parts of the layer of resistive material 51 that are not required for defining the, or each, discrete resistor 27 produces a splitter/combiner having minimal resistor parasitics.

FIG. 17 illustrates the construction of a second embodiment of a single Wilkinson power splitter/combiner. The same reference numerals as those used in FIGS. 1-16 are employed to indicate equivalent components and features, and only the ports of difference are described.

The substrate 28 and the dielectric membrane 33 are omitted for clarity so that the entire microwave circuit is clearly seen. The multi-layer laminate comprises the unshown substrate 28 which carries a resistive layer 70 covered by a first conductive layer 71 in the form of a 17 um copper foil, the first conductive layer 71 being covered by an unshown dielectric membrane covered with the conductive layer 34 constituting a second conductive layer.

This multi-layer laminate has been etched, for instance by using the aforesaid "Gould Process", or any convenient variant thereof, to leave the illustrated structure. From FIG. 17 is will be noted that the first conductive layer 71 has been etched to define the pair of arms 25 and 26 constituting the quarter-wave transformers, and indeed most of the microwave circuit. The resistive layer 70 has been etched to the same profile as the first conductive layer 71, except that an additional area has been left un-etched to define the resistor 27. The second conductive layer 34 has largely been etched away, leaving only three conductive connectors defining the ports 21, 22 and 23. In this manner the unshown substrate 28 will underlie the resistive layer 70, and the unshown dielectric membrane 33 will be positioned between the upper surface of the first conductive layer 71 and the lower surface of the second conductive layer 34.

Plated vias 72, 31 and 32 respectively connect the ports 21, 22 and 23 to the appropriate points of the first conductive layer 71 as shown. These vias are formed in any convenient manner, for instance by using an excimer laser, followed by electro-plating as for the first embodiment.

It will be noted that these vias 72, 31 and 32 are hollow. This form of via may also be used in the embodiment illustrated in FIGS. 1-16.

The microwave power splitter/combiner of FIGS. 1-16 has the advantage of minimising the number of vias, but can incur higher resistor parasitics.

On the other hand, the microwave power splitter/combiner of FIG. 17 has the advantage of avoiding asymmetry and discontinuities near the resistor 27, but requires an additional via.

While particular materials have been suggested for use in preferred embodiments of the present invention, it will be clear that other materials may be selected without departing from the scope of the invention.

The invention claimed is:

1. A microwave power splitter/combiner comprising a multi-layer laminate including a substrate carrying a resistive layer which has been etched to define a resistor, conductive pads secured to the resistor, a dielectric membrane covering the resistor, a conductive layer defining at least part of a microwave circuit of the power splitter/combiner, and two ports of the power splitter/combiner are electrically connected across the resistor by vias extending through the dielectric membrane, wherein the resistive layer has been etched to define a profile similar to the microwave circuit, the conductive layer defining the microwave circuit has been deposited on the etched profile of the resistive layer, and the two ports are electrically connected by the vias to the conductive pads.

2. A microwave power splitter/combiner according to claim 1, in which the resistive layer is formed from a nickel-phosphorus alloy.

3. A microwave power splitter/combiner comprising a multi-layer laminate including a substrate carrying a resistive layer which has been etched to define a resistor, a dielectric membrane covering the resistor, a conductive layer defining at least part of a microwave circuit of the power splitter/combiner, and two ports of the power splitter/combiner are electrically connected across the resistor by vias extending through the dielectric membrane, wherein the resistive layer has been etched to define a profile similar to the microwave circuit, the conductive layer defining the microwave circuit has been deposited on the etched profile of the resistive layer, the two ports are electrically connected by the vias to the microwave circuit, the resistive layer is formed from a nickel-phosphorus alloy, the resistive layer defines a discrete resistor, conductive pads are secured to the resistor, the conductive layer is formed on the opposite side of the dielectric membrane to the discrete resistor, and the two ports are electrically connected by the vias one to each of the conductive pads.

4. A microwave power splitter/combiner according to claim 3, in which the conductive pads are formed from copper.

5. A microwave power splitter/combiner according to claim 4, in which the multi-layer laminate includes a copper foil covering the resistive layer, and the copper foil has been etched to define the conductive pads.

6. A microwave power splitter/combiner according to claim 5, in which the dielectric membrane is formed from expanded poly-tetra-flouro-ethelyene impregnated with a thermoset resin.

7. A microwave power splitter/combiner according to claim 6, in which the conductive layer is formed from copper.

8. A method of manufacturing a microwave power splitter/combiner comprising forming a laminate including a substrate carrying a resistive layer, a first conductive layer carried by the resistive layer, a dielectric membrane covering the first conductive layer, and a second conductive layer covering the dielectric membrane, including etching the resistive layer and the first conductive layer to define a discrete resistor having conductive pads, etching the second conductive layer to define a microwave circuit of the power splitter/combiner, and forming electrically conductive vias through the dielectric membrane to connect two ports of the microwave circuit one to each of the conductive pads.

9. A method of manufacturing according to claim 8, including testing a resistance value of each of said resistors before placing the dielectric membrane over the conductive pads.

10. A method of manufacturing according to claim 8, including adjusting a resistance value of any of said resistors to a specified value before placing the dielectric membrane over the resistor.

11. A method of manufacturing a manifold power splitter/combiner comprising forming a laminate including a substrate carrying a resistive layer, a first conductive layer carried by the resistive layer, a dielectric membrane covering the first conductive layer, and a second conductive layer covering the dielectric membrane, including etching the resistive layer and the first conductive layer to define a plurality of discrete resistors each having conductive pads, etching the second conductive layer to define an equivalent plurality of ported microwave circuits of power splitters/combiners together with electrical interconnections, and forming electrically conductive vias through the dielectric membrane to connect two ports of each of said ported microwave circuits one to each of the conductive pads of one of the discrete resistors.

12. A method of manufacturing according to claim 11, including testing a resistance value of each of said resistors before placing the dielectric membrane over the conductive pads.

13. A method of manufacturing according to claim 11, including adjusting a resistance value of any of said resistors to a specified value before placing the dielectric membrane over the resistor.

* * * * *